US007712273B2

(12) United States Patent
Panasik et al.

(10) Patent No.: US 7,712,273 B2
(45) Date of Patent: May 11, 2010

(54) THERMAL BREAKER STRUCTURES FOR USE WITH ROOF DECKING ASSEMBLIES

(75) Inventors: Cheryl L. Panasik, Elburn, IL (US); Yongping Gong, Glenview, IL (US); Jeffrey M. Stupar, West Dundee, IL (US); Madhav S. Puppala, Lisle, IL (US); Owen J. McGarel, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1071 days.

(21) Appl. No.: 11/042,389

(22) Filed: Jan. 25, 2005

(65) Prior Publication Data

US 2006/0174571 A1 Aug. 10, 2006

(51) Int. Cl.
*E04C 3/00* (2006.01)
*E04D 1/36* (2006.01)

(52) U.S. Cl. ..... 52/459; 52/478; 52/543; 52/713

(58) Field of Classification Search ..... 52/459, 52/717.02, 478, 543, 713
See application file for complete search history.

(56) References Cited

U.S. PATENT DOCUMENTS

| | | | | |
|---|---|---|---|---|
| 4,031,681 | A * | 6/1977 | Charniga | 52/408 |
| 4,034,532 | A | 7/1977 | Reinwall, Jr. | |
| 4,110,948 | A | 9/1978 | Maier, Jr. | |
| 4,193,247 | A | 3/1980 | Heckelsberg | |
| 4,393,633 | A * | 7/1983 | Charniga | 52/302.3 |
| 4,400,922 | A | 8/1983 | Boyer | |
| 4,402,168 | A * | 9/1983 | Maier, Jr. | 52/478 |
| 4,466,224 | A | 8/1984 | Hague | |
| 4,514,952 | A * | 5/1985 | Johansson | 52/713 |
| 4,557,098 | A | 12/1985 | Thurnau et al. | |
| 4,570,404 | A * | 2/1986 | Knudson | 52/520 |
| 4,575,983 | A | 3/1986 | Lott, Jr. et al. | |
| 4,796,403 | A | 1/1989 | Fulton et al. | |
| 5,001,882 | A | 3/1991 | Watkins et al. | |
| 5,127,205 | A | 7/1992 | Eidson | |
| 5,181,360 | A * | 1/1993 | Shingler | 52/520 |
| 5,511,354 | A | 4/1996 | Eidson | |
| 5,557,903 | A | 9/1996 | Haddock | |
| 5,715,640 | A * | 2/1998 | Haddock | 52/545 |
| 5,720,144 | A * | 2/1998 | Knudson et al. | 52/481.1 |
| 5,743,036 | A * | 4/1998 | Zumwalt | 40/359 |
| 5,867,959 | A * | 2/1999 | Ruble et al. | 52/545 |
| 6,594,964 | B2 * | 7/2003 | Charland | 52/302.1 |
| 6,715,256 | B1 | 4/2004 | Fischer | |
| 6,845,592 | B2 * | 1/2005 | Voegele | 52/466 |
| 7,174,686 | B1 * | 2/2007 | Legband | 52/471 |
| 2003/0145548 | A1 | 8/2003 | Mitchell | |
| 2003/0188500 | A1 | 10/2003 | Voegele | |
| 2005/0011154 | A1 | 1/2005 | Kim | |

* cited by examiner

*Primary Examiner*—Richard E Chilcot, Jr.
*Assistant Examiner*—Mark R Wendell
(74) *Attorney, Agent, or Firm*—Law Offices of Steven W. Weinrieb

(57) ABSTRACT

Thermal breaker or thermal barrier structures are disclosed for use in connection with roof decking assemblies wherein the thermal breaker or thermal barrier structures effectively prevent the respective transmission of heating gradients from the interior or exterior building environments to the exterior or interior building environments by thermal conductivity so as to render buildings more energy efficient.

6 Claims, 7 Drawing Sheets

FIG. 1
(PRIOR ART)
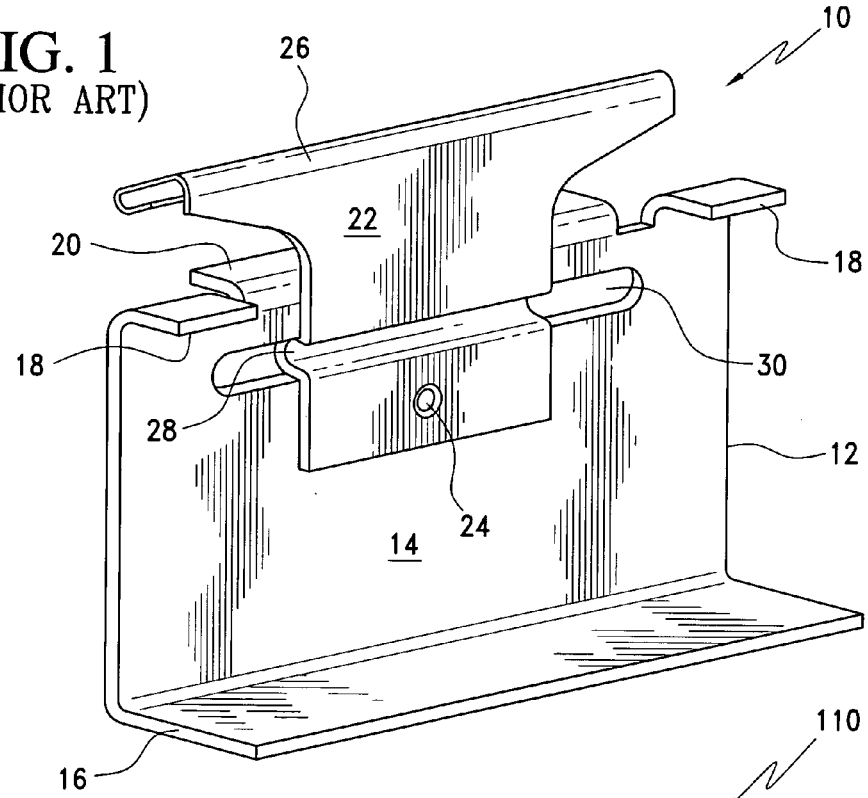
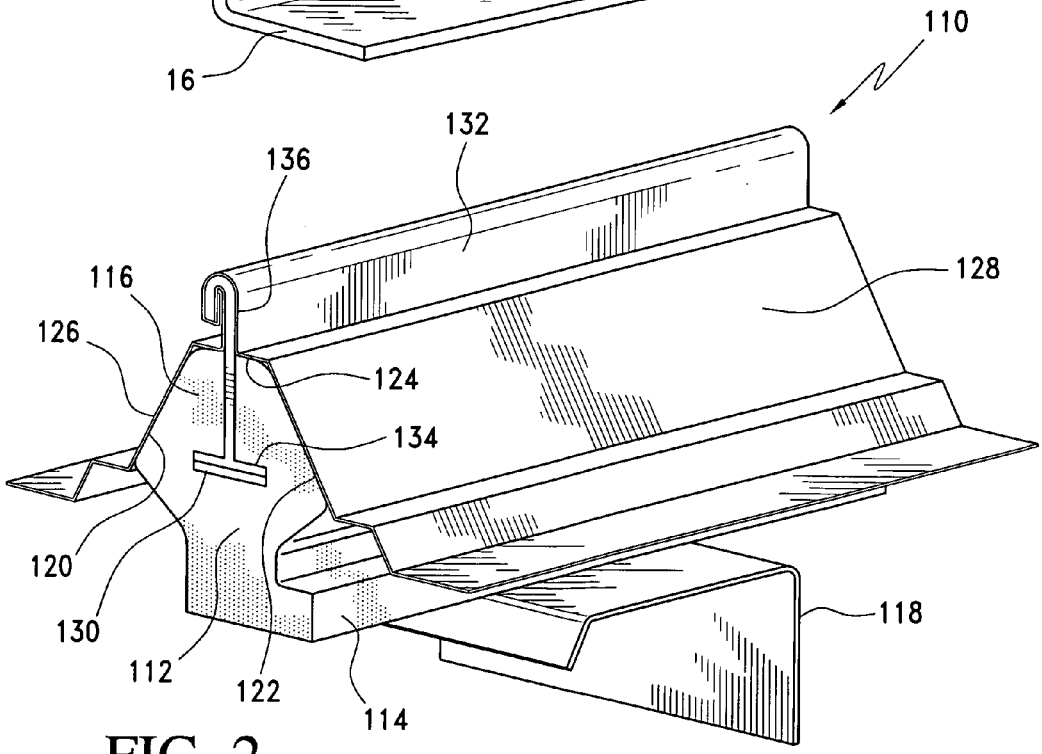
FIG. 2
(PRIOR ART)

FIG. 3
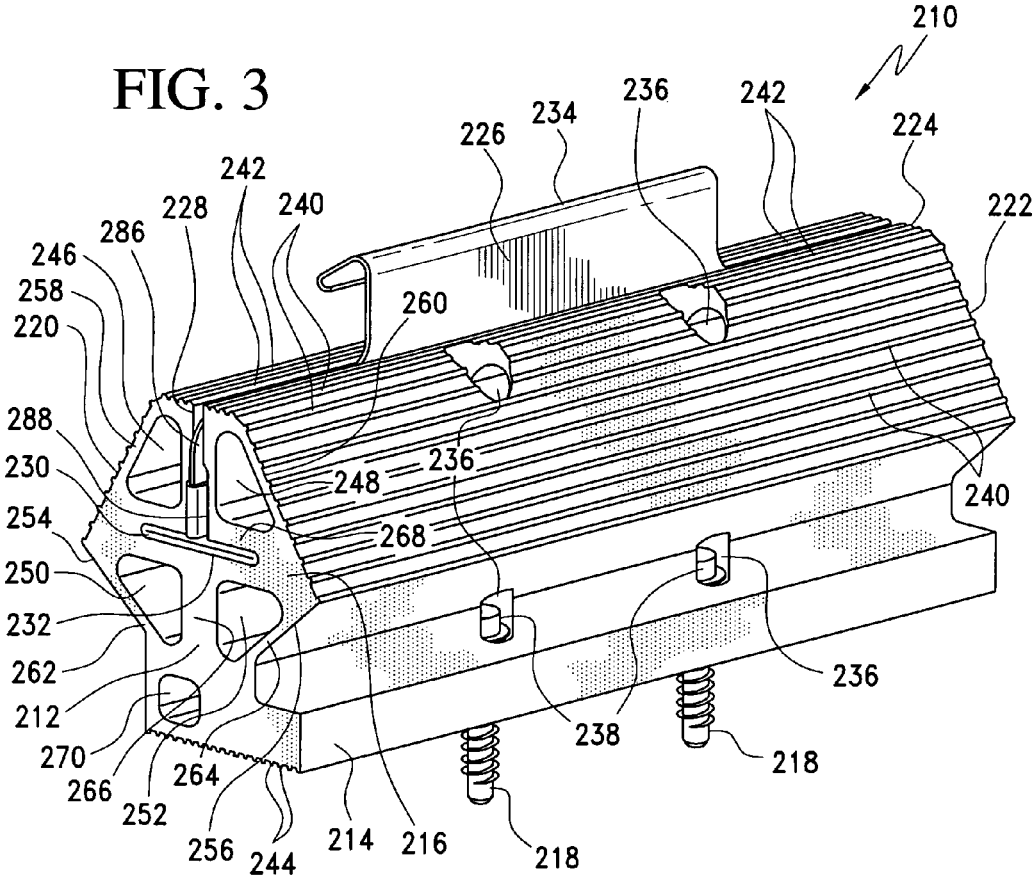
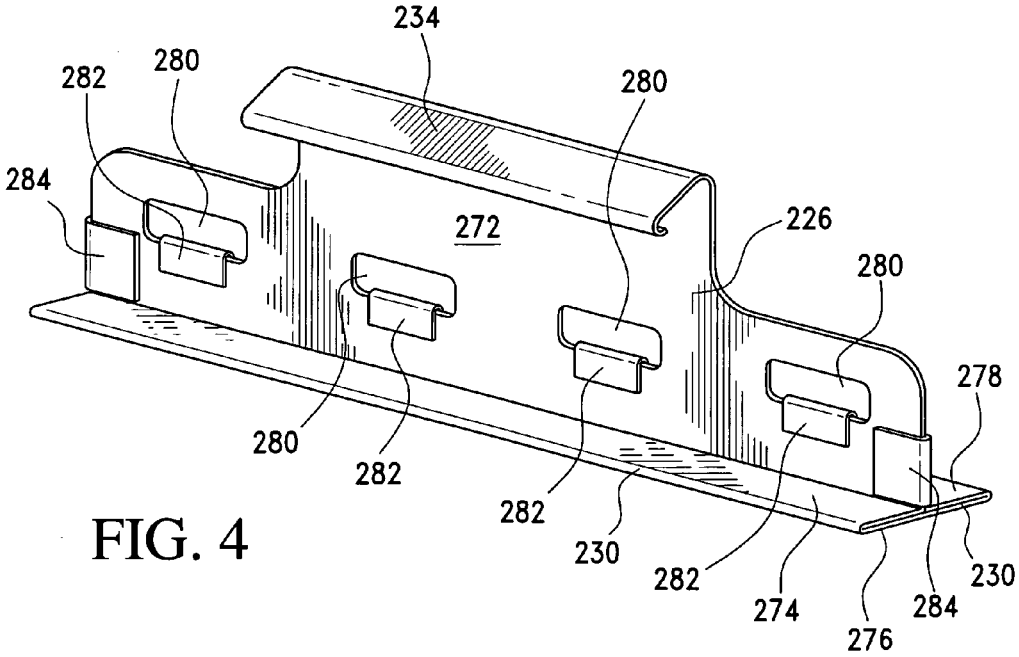
FIG. 4

FIG. 5
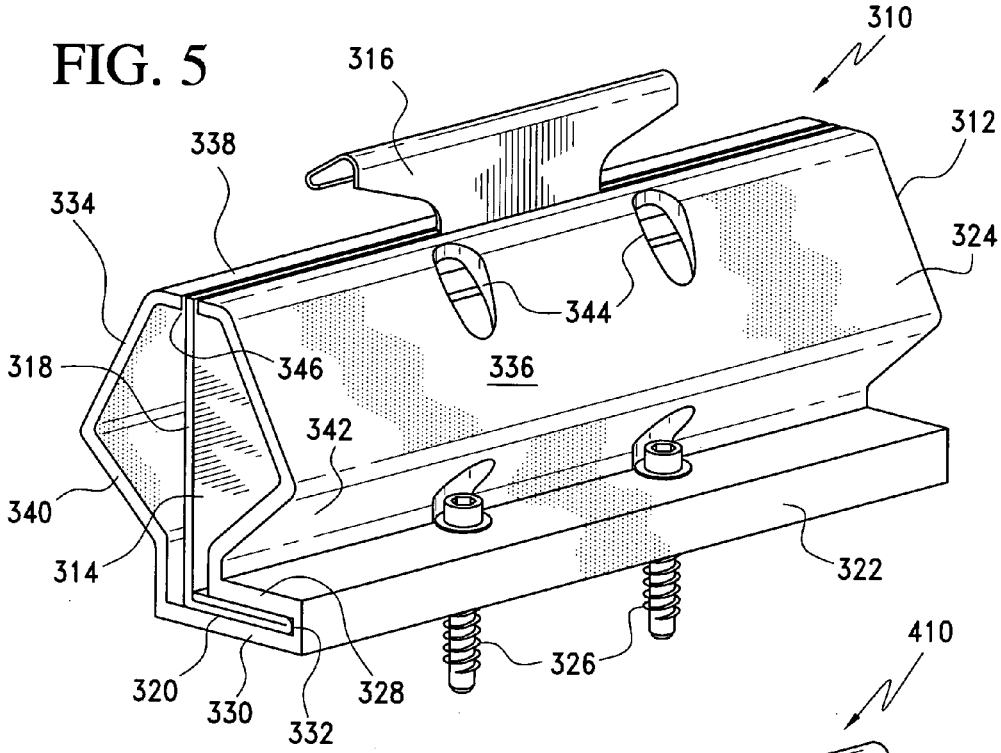
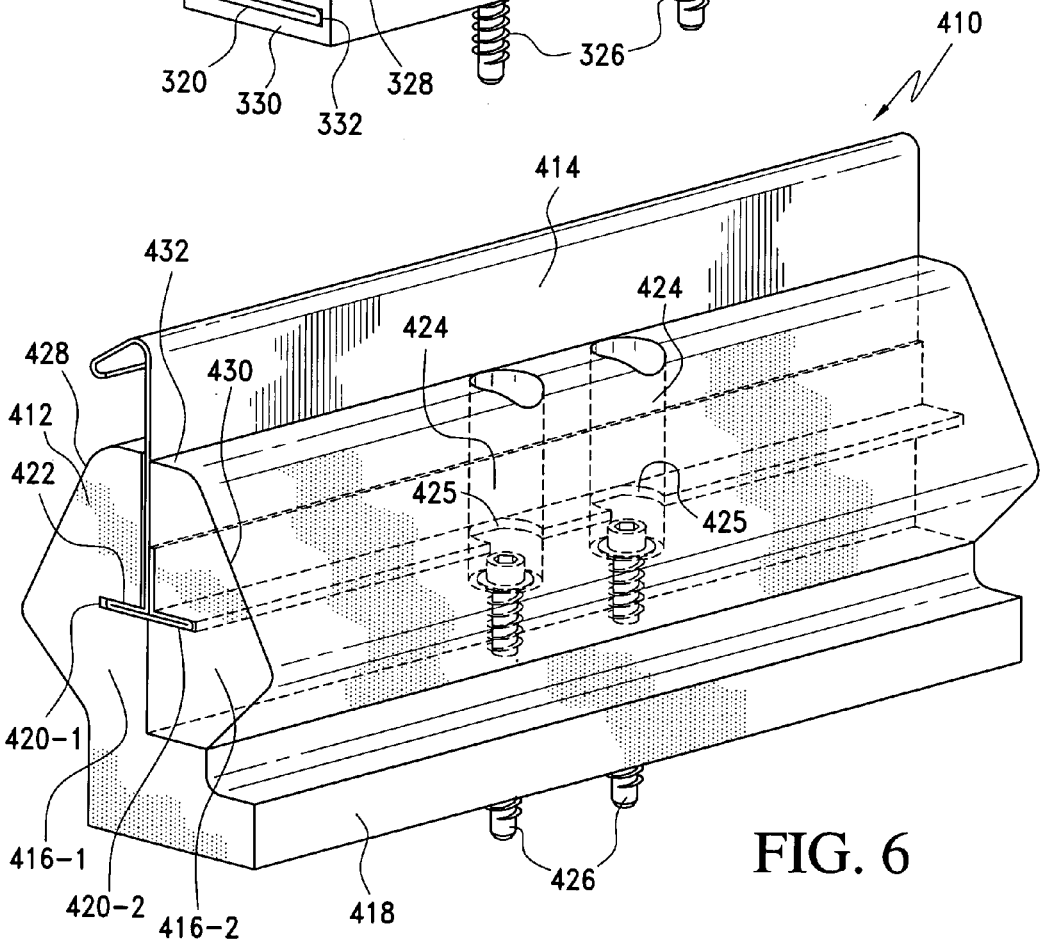
FIG. 6

FIG. 7
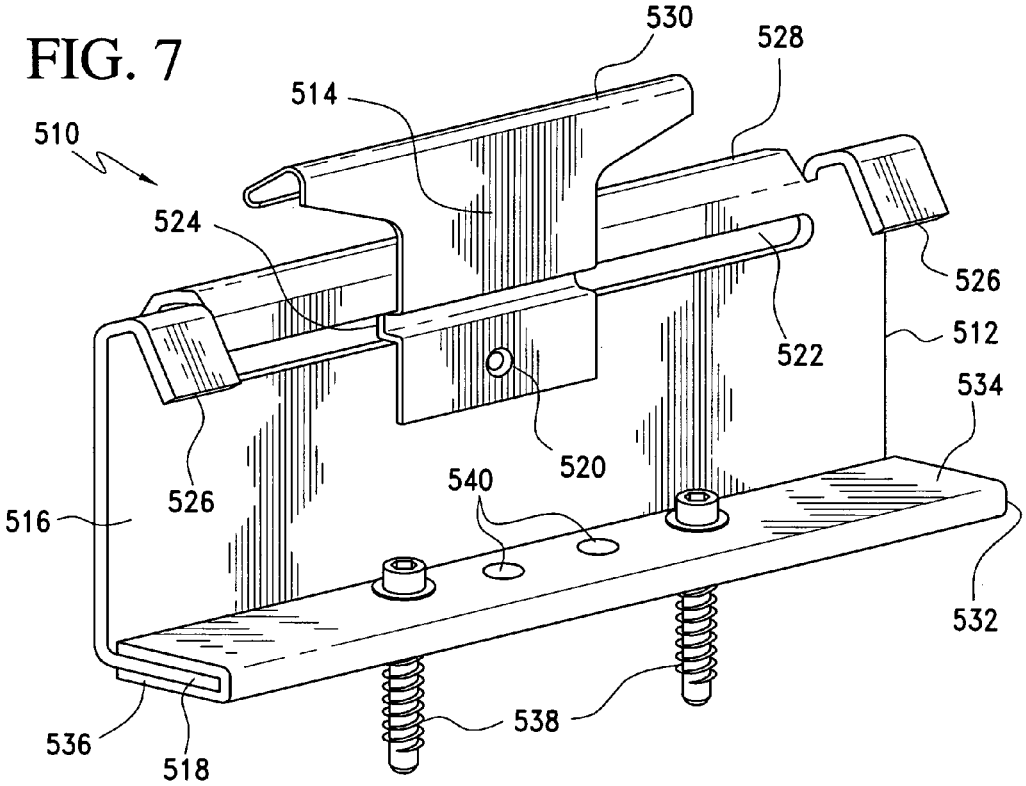
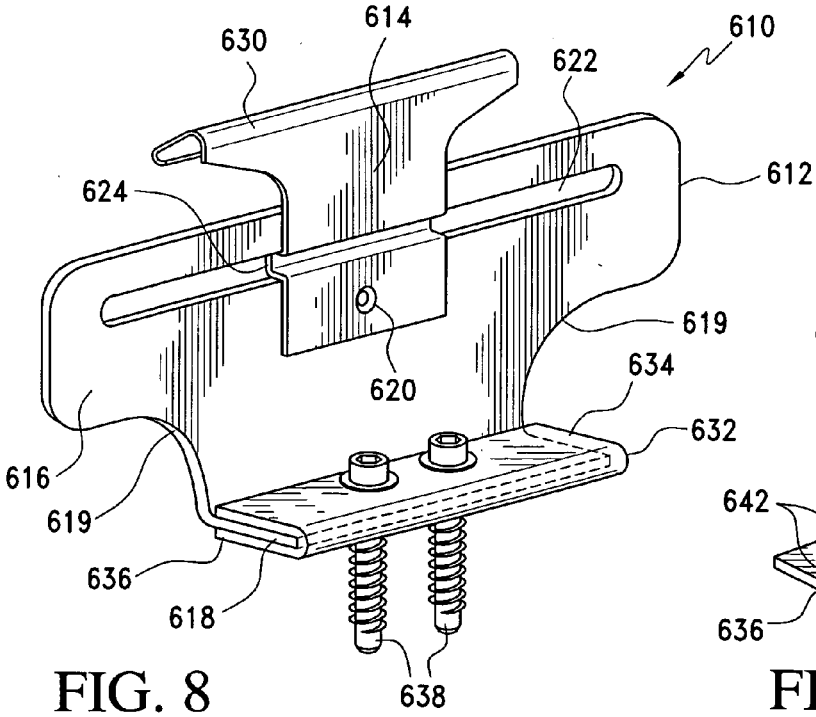
FIG. 8
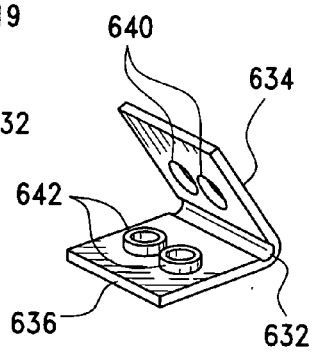
FIG. 8A

FIG. 9
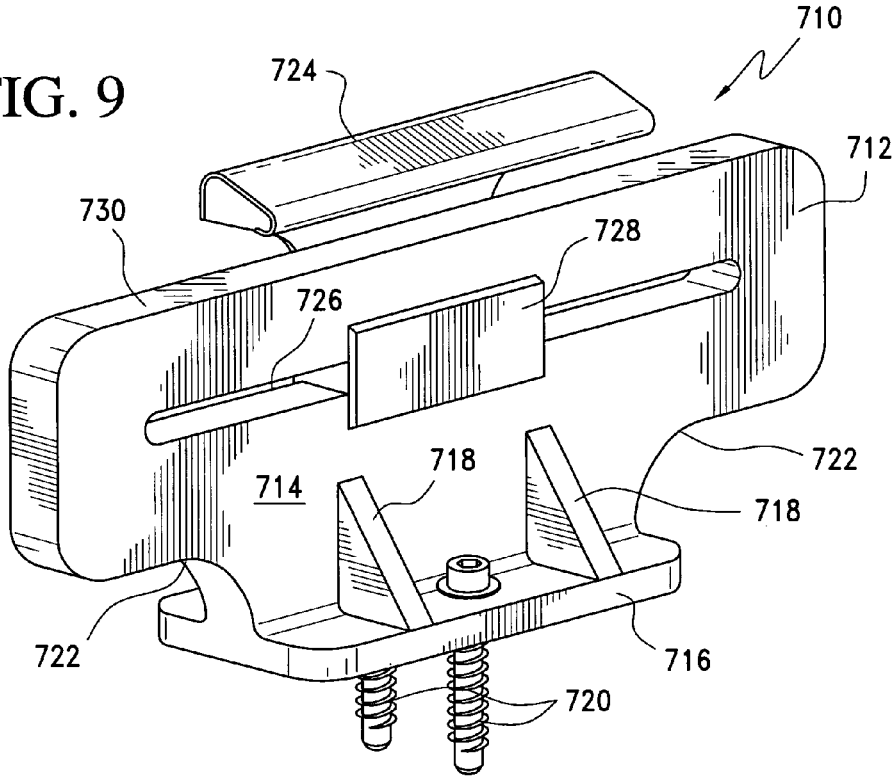
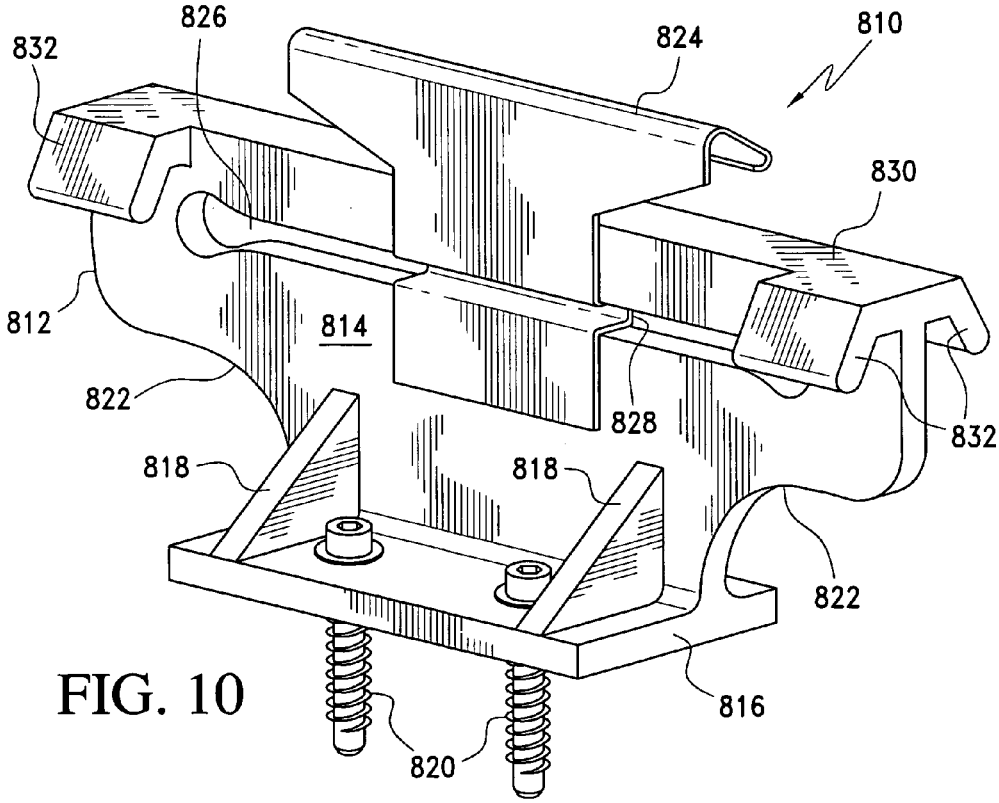
FIG. 10

FIG. 11
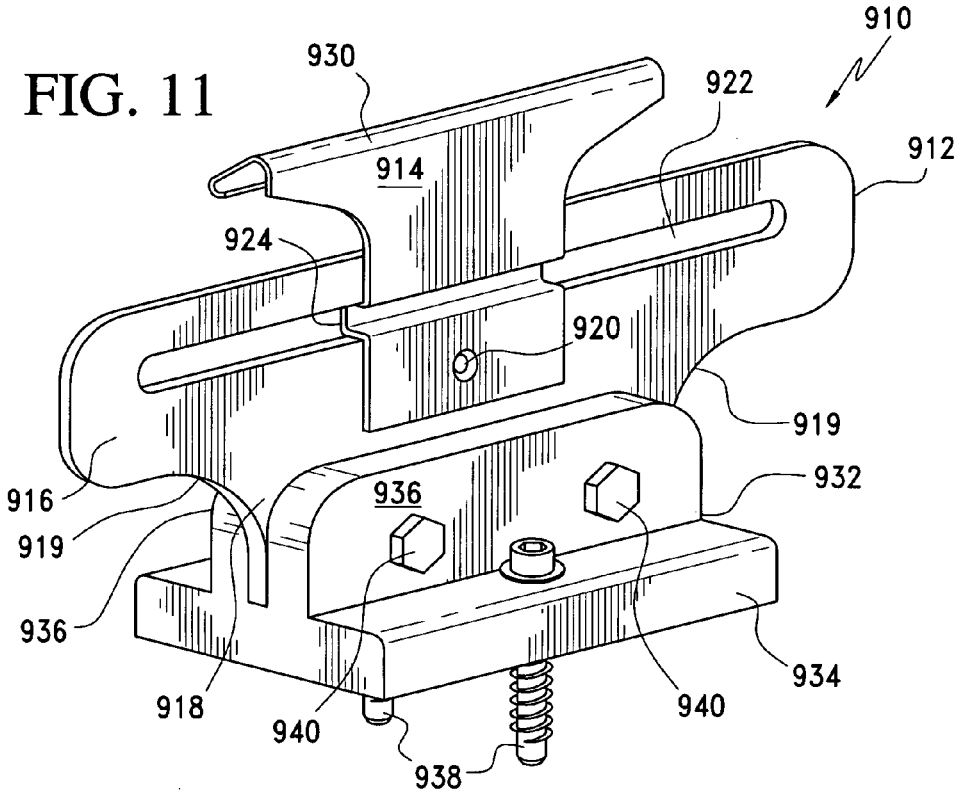
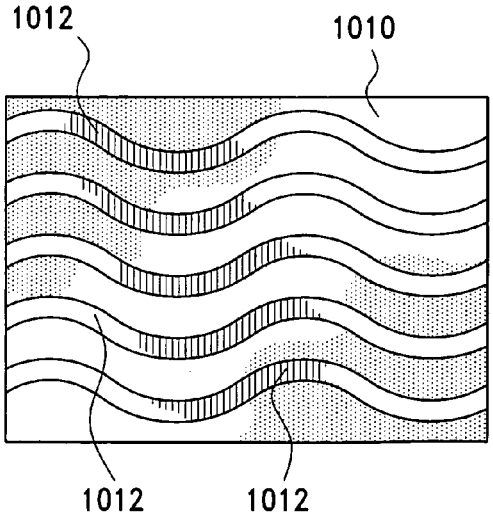
FIG. 12
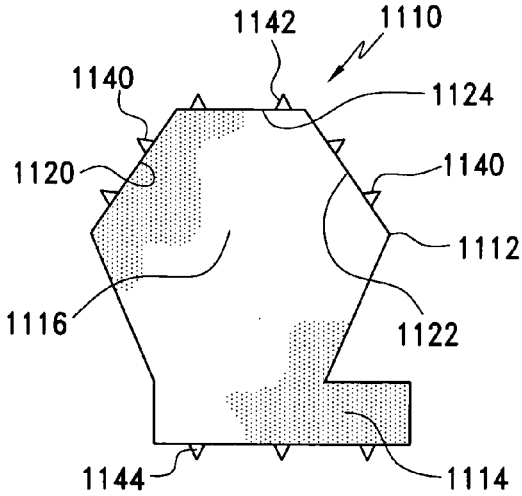
FIG. 13

THERMAL BREAKER STRUCTURES FOR USE WITH ROOF DECKING ASSEMBLIES

FIELD OF THE INVENTION

The present invention relates generally to thermal breaker or thermal barrier structures, and more particularly to new and improved thermal breaker or thermal barrier structures for use in connection with roof decking assemblies for effectively preventing the respective transmission of heating gradients from the interior or exterior building environment to the exterior or interior building environment by thermal conductivity so as to render the building more energy efficient. While the thermal breaker or thermal barrier structure of the present invention will be described in connection with roof decking assemblies, it is to be appreciated that the attributes of the thermal breaker or thermal barrier of the present invention can likewise be applicable to other controlled environment structures and the component parts thereof, such as, for example, automobiles, airplanes, refrigerators, freezers, windows, walls, computers and other electronic components, and the like.

BACKGROUND OF THE INVENTION

Steel fasteners, clips, and other means, used for securing external structural component parts to internal component parts wherein the external structural component parts are exposed to hot or cold weather conditions, allow heat to escape from the thermally heated interior region of, for example, a building or dwelling, or alternatively, allow heat to effectively invade the thermally cooled or air-conditioned interior region of the building or dwelling, by thermal conductivity. For example, a conventional PRIOR ART clip and tab assembly, for fixedly securing roofing panels to an underlying roofing substructure, is disclosed within FIG. 1 and is generally indicated by the reference character 10. More particularly, it is seen that the conventional PRIOR ART clip and tab assembly 10 comprises a substantially L-shaped clip 12 comprising a vertically oriented long leg component 14 and a horizontally oriented short leg component 16. The horizontally oriented short leg component 16 is adapted to be seated upon and fixedly connected to a joist member of the underlying roofing substructure by means of, for example, screw fasteners, while the upper end portion of the vertically oriented long leg component 14 is provided with a pair of laterally spaced lugs 18,18 bent at an angle of substantially 90° with respect to the vertically oriented long leg component 14 so as to be disposed substantially parallel to the horizontally oriented short leg component 16, and a centrally located lug 20 which is also bent at an angle of substantially 90° with respect to the vertically oriented long leg component 14, so as to likewise be disposed substantially parallel to the horizontally oriented short leg component 16, the lugs 18, 20 extending in opposite directions. Taken together, the lugs 18,20 effectively define shelf, ledge, or support surfaces upon which mating crest portions of adjacent roofing panels, forming the roof decking, are adapted to be respectively seated.

A tab member 22 is fixedly mounted upon the vertically oriented long leg component 14 of the clip 12 by means of a dimpled detent 24 or the like for permitting the tab member 22 to be retained at the central position upon the clip 12 but nevertheless movable toward the left or right as viewed in the drawing figure, while the horizontally oriented leg component 16 of the clip 12 is adapted to be fixedly connected to a joist member, not shown, of an underlying roofing substructure. The upper end portion of the tab member 22 is provided with a substantially arcuate portion 26 which is adapted to internally accommodate an upstanding portion of one of the mating adjacent roofing panels while the upstanding portion of the other one of the mating adjacent roofing panels is adapted to be disposed upon the external surface region of the arcuate portion 26 of the tab member 22 such that the two upstanding portions of the mating adjacent roofing panels form with the arcuate portion 26 of the tab member 22 a three-piece sandwich or laminated structure. In this manner, when such sandwich or laminated structure, comprising the pair of upstanding portions of the mating adjacent roofing panels and the arcuate portion 26 of the tab member 22, is subsequently rolled and crimped, the mating adjacent roofing panels are fixedly secured to the joist member of the underlying roofing substructure through means of the clip and tab assembly 10. An outwardly projecting portion 28 of the tab member 22, disposed within the slot 30 of the vertical leg 14 of the clip 12 permits the tab member 22, and the adjacent roofing panels connected thereto, to undergo lateral movement in accordance with expansion and contraction conditions attendant the roofing panels. With the aforenoted clip and tab assembly 10, it can readily be appreciated, however, that a thermal flow path is directly established or defined between the joist member, which is disposed internally within the building structure, and the roofing panels which are disposed externally of the building structure through means of the clip 12 and the tab member 22, as well as the screws securing the clip 12 to the underlying joist member. Accordingly, heat from the heated environment disposed or contained internally within the building structure can effectively escape to the outside cold weather environment, or alternatively, heat from the outside hot weather environment can effectively invade the cooled or air-conditioned environment disposed or contained internally within the building structure. A need therefore existed in the art for effectively breaking or interrupting the aforenoted thermal flow path so as to terminate or prevent the egress or ingress of the heat or thermal energy out from or into the building structure.

Accordingly, the thermal breaker or thermal barrier assembly, as disclosed within FIG. 2 and generally indicated by the reference character 110, was developed in an attempt to address and resolve the aforenoted problems or deficiencies characteristic of the clip and tab assembly 10 disclosed within FIG. 1. More particularly, the thermal breaker or thermal barrier assembly 110 is seen to comprise a thermal breaker or thermal barrier member 112 which is fabricated from a suitable plastic material by means of an injection molding process, and it is seen that the thermal breaker or thermal barrier member 112 comprises a horizontally disposed lower base portion 114 and an upper domed portion 116. The lower base portion 114 is adapted to be seated upon and secured to a joist member 118 of the underlying roofing substructure, and the upper domed portion 116 is seen to have a substantially diamond-shaped cross-sectional configuration. More particularly, it is seen that the upper domed portion 116 has oppositely disposed inclined surface regions 120,122, as well as an upper substantially planar surface region 124 which is disposed substantially parallel to the horizontally oriented lower base portion 114.

In this manner, side edge portions of a pair of adjacent roofing panels 126,128 can be supported upon the oppositely disposed inclined surface regions 120,122, as well as upon the upper substantially planar surface region 124, of the thermal breaker or thermal barrier member 112 so as to be mated and connected together. The central region of the upper domed portion 116 of the thermal breaker or thermal barrier member 112 is provided with a slot 130 having a substantially inverted T-shaped cross-sectional configuration, and a clip 132, having a substantially T-shaped cross-sectional configuration, is disposed in an inverted mode such that the head portion 134 of the clip 132 is disposed internally within the transverse portion of the slot 130 while the opposite free end portion 136 of the clip 132 projects outwardly from the thermal breaker or thermal barrier member 112 so as to be operatively crimped together with the side edge portions of the pair of adjacent roofing panels 126,128, thereby fixedly securing the pair of adjacent roofing panels 126,128 to the joist member 118 of the underlying substructure.

While the aforenoted thermal breaker or thermal barrier 110 ostensibly appears to resolve the problems noted hereinbefore with respect to the conventional PRIOR ART clip and tab assembly 10 as disclosed within FIG. 1, in that a thermal breaker or thermal barrier is in fact effectively interposed between the joist member 118 and the pair of mated roofing panels 126,128, the thermal breaker or thermal barrier assembly 110 nevertheless still poses or exhibits some undesirable operational and fabrication characteristics. For example, since the thermal breaker or thermal barrier member 112 is fabricated by injection molding techniques, and since the volume encompassed by means of the thermal breaker or thermal barrier member 112 is substantial, in that the thermal breaker or thermal barrier member 112 has a length dimension of eight inches (8.00") and a height dimension of two inches (2.00"), the thermal breaker or thermal barrier member 112 is costly to manufacture due to material costs and injection molding cycle time. In addition, even though the thermal breaker or thermal barrier member 112 is in fact fabricated from a suitable plastic material, it is noted that a predetermined axially located region of the thermal breaker or thermal barrier member 112 has its complete undersurface portion of the base portion 114 disposed in contact with the underlying joist member 118, while the upper domed region 116 of the thermal breaker or thermal barrier member 112 has its inclined surface portions 120,122, and its upper planar portion 124, disposed in complete surface contact with the pair of mated adjacent roofing panels 126,128.

Accordingly, since the roofing panels 126,128 are exposed, for example, to cold external atmospheric air, while the joist member 118 is exposed to an internally heated environment, or alternatively, since the roofing panels 126,128 are exposed, for example, to hot external atmospheric air, while the joist member 118 is exposed to an internally cooled or air-conditioned environment, the thermal path extending between the interior of the building structure and the external atmospheric environment remains intact whereby heat loss or egress of thermal energy out from the interior of the building structure, or the ingress of thermal energy into the building structure, can effectively continue at an undesirable rate. Still yet further, it is noted that the clip 132 is fabricated as a single sheet member which is effectively folded in a predetermined manner, and along predetermined fold lines, so as to effectively form the final clip structure. It is noted, however, that the folded and mated regions of the clip are not in fact fixedly secured with respect to each other. Accordingly, wind uplift forces can cause the clip 132 to fail in view of the fact that the wind uplift forces will not be evenly impressed upon or evenly distributed throughout the various sections or regions of the clip 132.

A need therefore exists in the art for a new and improved thermal breaker or thermal barrier assembly which is capable of being manufactured in a cost-effective manner, which effectively rectifies the deficiencies characteristic of the conventional PRIOR ART thermal breaker or thermal barrier structures so as to in fact significantly reduce the amount of heat loss or egress of thermal energy out from the interior of the building structure, or the ingress of thermal energy into the building structure, and which comprises a clip member, for effectively connecting together the edge portions of the adjacent roofing panels, which is rigidified in a predetermined manner so as to effectively reinforce itself and thereby be capable of resisting wind uplift forces such that the clip member does not exhibit failure under wind uplift force conditions.

SUMMARY OF THE INVENTION

The foregoing and other objectives are achieved in accordance with the teachings and principles of the present invention through the provision of a new and improved thermal breaker or thermal barrier assembly which comprises a new and improved thermal breaker or thermal barrier member which is fabricated from a suitable plastic material by means of a suitable pulltrusion, injection molding, machining, or extrusion process. In addition, the thermal breaker or thermal barrier member is provided with a plurality of axially extending voids or passageways, which are distributed throughout the thermal breaker or thermal barrier member in a predetermined symmetrical arrangement or array, wherein not only do such voids or passageways effectively provide thermal insulation characteristics, but in addition, such voids or passageways eliminate a substantial volume of the plastic material required to fabricate the thermal breaker or thermal barrier member so as to render the same more economical or cost-effective to produce. Still further, the presence of such axially extending voids or passageways, within such predetermined symmetrical array or arrangement, provides the thermal breaker or thermal barrier member with a plurality of vertically and horizontally oriented, reinforcing structural rib members. Still yet further, all of the external surface portions of the thermal breaker or thermal barrier member, that are disposed in contact with the pair of adjacent roofing panels, as well as with the underlying joist member, are discontinuous such that the locations at which the pair of adjacent roofing panels, or at which the underlying joist member, are disposed in contact with the thermal breaker or thermal barrier, comprise point loci or linear loci.

In this manner, the overall surface-to-surface contact defined between the edge portions of the pair of adjacent roofing panels and the external surface portions of thermal breaker or thermal barrier member upon which the edge portions of the pair of adjacent roofing panels are seated, as well as between the external undersurface region of the base portion of the thermal breaker or thermal barrier and the underlying joist member upon which the base portion of the thermal barrier or thermal breaker member is seated, is effectively minimized. Accordingly, the thermal path extending between the interior of the building structure and the external atmospheric environment is effectively broken and is no longer intact, whereby heat loss or egress of thermal energy out from the interior of the building structure, or the ingress of thermal energy into the building structure, is significantly reduced. Still further, the fabrication of the clip member is such that portions of a first folded and mating ply of the clip member are fixedly secured to corresponding portions of the second folded and mating ply of the clip member whereby the mated portions of the clip member cannot in fact separate with respect to each other under, for example, wind uplift forces, whereby the clip member will exhibit significant wind uplift force resistance and will not exhibit failure under wind uplift conditions.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 1 is a perspective view of a conventional PRIOR ART clip and tab assembly used for fixedly connecting mating edge portions of adjacent roofing panels to underlying joist members of a roof decking substructure;

FIG. 2 is a perspective view of a conventional PRIOR ART thermal breaker or thermal barrier assembly which includes therein a clip and tab assembly for fixedly connecting mating edge portions of adjacent roofing panels to underlying joist members of a roof decking substructure;

FIG. 3 is a perspective view of a first embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 4 is a perspective view of the clip, mounted within the thermal breaker or thermal barrier member disclosed within FIG. 3, which is effectively used to crimpingly secure together the side edge portions of the adjacent roofing panels, thereby effectively securing the roofing panels to the underlying joist member through means of the thermal breaker or thermal barrier member;

FIG. 5 is a perspective view of a second embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 6 is a perspective view of a third embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 7 is a perspective view of a fourth embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 8 is a perspective view of a fifth embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 8*a* is an enlarged detail view of the sleeve member incorporated within the thermal breaker or thermal barrier assembly of FIG. 8;

FIG. 9 is a perspective view of a sixth embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 10 is a perspective view of a seventh embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 11 is a perspective view of an eighth embodiment of a new and improved thermal breaker or thermal barrier assembly which has been constructed in accordance with the principles and teachings of the present invention, and which shows the cooperative parts thereof, for fixedly connecting mating edge portions of adjacent roofing panels to underlying joist members of a roof decking substructure;

FIG. 12 is a schematic plan view of a second embodiment of wavy or sinusoidal structure which may effectively be incorporated onto any of the external surface regions of the thermal barrier or thermal breaker member, in lieu of the axially oriented rib members as disclosed within FIG. 3, so as to minimize the surface contact area and thereby render the thermal breaker or thermal barrier assembly more thermally efficient;

FIG. 13 is a side elevational view of a third embodiment of projection structure which may effectively be incorporated onto the external inclined surface regions and the upper planar region, as well as upon the undersurface region of the lower base portion, of the domed portion of the thermal barrier or thermal breaker in, lieu of the axially oriented rib members as disclosed within FIG. 3, so as to minimize the surface contact area;

DETAILED DESCRIPTION OF THE ILLUSTRATED EMBODIMENTS

Figure 14:
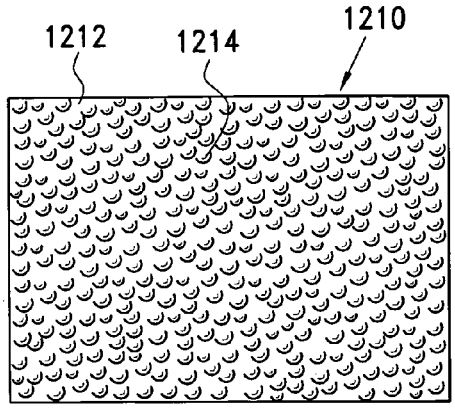
FIG. 14 is a schematic plan view of a fourth embodiment of orange rind structure which may effectively be incorporated onto any of the external surface regions of the thermal barrier or thermal breaker member, in lieu of the axially oriented rib members as disclosed within FIG. 3, so as to minimize the surface contact area and thereby render the thermal breaker or thermal barrier assembly more thermally efficient.
Figure 15:
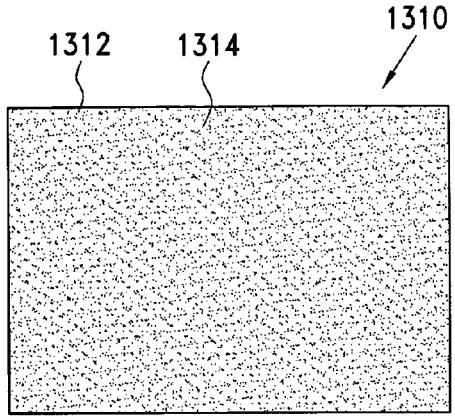
FIG. 15 is a schematic plan view of a fifth embodiment of coarse finish structure which may effectively be incorporated onto any of the external surface regions of the thermal barrier or thermal breaker member, in lieu of the axially oriented rib members as disclosed within FIG. 3, so as to minimize the surface contact area and thereby render the thermal breaker or thermal barrier assembly more thermally efficient.

Referring now to the drawings, and more particularly to FIG. 3 thereof, a first embodiment of a new and improved thermal breaker or thermal barrier assembly, which has been constructed in accordance with the principles and teachings of the present invention, and which shows the cooperative parts thereof, for fixedly connecting mating edge portions of adjacent roofing panels to underlying joist members of a roof decking substructure, is disclosed and is generally indicated by the reference character 210. More particularly, the thermal breaker or thermal barrier assembly 210 is seen to comprise a thermal breaker or thermal barrier member 212 which is fabricated from a suitable plastic material by means of a pulltrusion process, wherein, for example, the plastic material comprises a thermoset polyvinylester crosslinked material. It is seen that the thermal breaker or thermal barrier member 212 comprises a horizontally disposed lower base portion 214 and an upper domed portion 216. The lower base portion 214 is adapted to be seated upon and secured to a joist member, not illustrated but similar to the joist member 118 illustrated within FIG. 2, of an underlying roofing substructure by means of, for example, a pair of headed bolt fasteners 218, and the upper domed portion 216 is seen to have a substantially diamond-shaped cross-sectional configuration. More particularly, it is seen that the upper domed portion 216 has oppositely disposed inclined surface regions 220,222, as well as an upper substantially planar surface region 224 which is disposed substantially parallel to the horizontally oriented lower base portion 214.

In this manner, side edge portions of a pair of adjacent roofing panels, also not illustrated but similar to the roofing panels 126,128 illustrated within FIG. 2, can be supported upon the oppositely disposed inclined external surface regions 220,222, as well as upon the upper substantially planar surface region 224, of the thermal breaker or thermal barrier member 212 so as to be mated and connected together by means of a clip 226 in a manner similar to that achieved by means of the clip 132 illustrated within FIG. 2. The central region of the upper domed portion 216 of the thermal breaker or thermal barrier member 212 is provided with a slot 228 having a substantially inverted T-shaped cross-sectional configuration, and it is seen that the clip 226, also having a substantially T-shaped cross-sectional configuration, is disposed in an inverted mode such that the head portion 230 of the clip 226 is disposed internally within the transverse portion 232 of the slot 228 while the opposite free end portion 234 of the clip 226 projects outwardly from the thermal breaker or thermal barrier member 212 so as to form a tab which can be operatively crimped together with the side edge portions of the pair of adjacent roofing panels, in a manner illustrated within FIG. 2, thereby fixedly securing the pair of adjacent roofing panels to the joist member of the underlying substructure.

In connection with the mounting or disposition of the pair of headed bolt fasteners 218,218 within the lower base portion 214 of the thermal barrier or thermal breaker member 212, a pair of vertically oriented bores 236,236 pass through the thermal breaker or thermal barrier member 212 so as to permit the pair of headed bolt fasteners 218,218 to be inserted into the thermal breaker or thermal barrier member 212. It is noted that the upper regions of the bores 236,236, as well as sections, not shown, of the head portion 230 of the clip 226, are effectively cut out and counterbored so as to permit the head portions 238,238 of the headed bolt fasteners 218, 218 to pass therethrough, however, the lower regions of the bores 236,236 are not counterbored so as to permit or cause the head portions 238,238 of the headed bolt fasteners 218, 218 to be seated, in effect, atop the lower base portion 214 of the thermal breaker or thermal barrier member 212.

In accordance with several additional unique and novel features characteristic of the new and improved thermal breaker or thermal barrier assembly 210 of the present invention, in order to render the same more thermally efficient, or, in other words, to effectively prevent thermal heat loss, it is seen that, as can be further appreciated from FIG. 3, each one of the oppositely disposed inclined external surface regions 220,222 of the thermal breaker or thermal barrier member 212 is integrally provided with a plurality of axially extending rib members 240. In a similar manner, it is seen that the upper planar surface region 224 of the thermal barrier or thermal breaker member 212 is likewise provided with a plurality of axially extending rib members 242, and still further, the undersurface region of the lower base portion 214 of the thermal breaker or thermal barrier member 212 is also provided with a plurality of axially extending rib members 244. In this manner, in lieu of the side edge portions of the pair of adjacent roofing panels, not illustrated but similar to the roofing panels 126,128 illustrated within FIG. 2, being respectively supported upon the oppositely disposed inclined external surface regions 220,222 of the thermal breaker or thermal barrier member 212, as well as upon the upper planar surface region 224 of the thermal barrier or thermal breaker 212, in a substantially surface-to-surface contact mode, the side edge portions of the pair of adjacent roofing panels will be respectively supported upon the oppositely disposed inclined external surface regions 220,222 of the thermal breaker or thermal barrier member 212, as well as upon the upper planar surface region 224 of the thermal barrier or thermal breaker member 212, along linear loci defined by means of each one of the axially rib members 240,242. This arrangement for supporting the pair of adjacent roofing panels upon the oppositely disposed inclined external surface regions 220,222 of the thermal breaker or thermal barrier member 212, as well as upon the upper planar surface region 224 of the thermal breaker or thermal barrier member 212, therefore significantly reduces the contact area defined between the pair of adjacent roofing panels and the oppositely disposed inclined external surface regions 220,222 of the thermal barrier or thermal breaker member 212, as well as between the pair of adjacent roofing panels and the upper planar surface region 224 of the thermal breaker or thermal barrier member 212, so as to militate against the transmission of thermal gradients across such structural interfaces. A similar reduction in the transmission of thermal gradients across the interface defined between the lower base portion of the thermal breaker or thermal barrier member 212 and the underlying joist member, similar to the joist member 118 as illustrated within FIG. 2, is likewise achieved by means of the plurality of axially extending rib members 244 provided upon the underlying exterior surface of the lower base portion 214 of the thermal breaker or thermal barrier member 212.

With reference still being made to FIG. 3, another unique and novel structural feature, characteristic of the new and improved thermal breaker or thermal barrier assembly 210 of the present invention, resides in the provision or formation of a plurality of axially extending voids or passageways within the thermal breaker or thermal barrier member 212. More particularly, it is seen that, for example, four axially extending voids or passageways 246,248,250,252 are formed within the thermal breaker or thermal barrier member 212, and that the four axially extending voids or passageways 246,248,250, 252 are disposed within a substantially symmetrical array around the longitudinal axis of the thermal breaker or thermal barrier member 212 which would be located within the vicinity of the transverse portion 232 of the inverted T-shaped slot 228. Each one of the four axially extending voids or passageways 246,248,250,252 has a substantially right-triangular cross-sectional configuration, and as a result of being disposed within the aforenoted predetermined substantially symmetrical array, the hypotenuse portions of each substantially right-triangularly configured void or passageway 246, 248,250,252 are respectively disposed within the vicinities of, and substantially parallel to, both the upper inlined external surface regions 220,222 of the thermal breaker or thermal barrier member 212, as well as the lower inclined external surface regions 254,256 which effectively interconnect the upper domed region 216 of the thermal breaker or thermal barrier member 212 to the lower base portion 214 of the thermal barrier or thermal breaker member 212.

In this manner, it is seen that four inclined rib members 258,260,262,264 are effectively defined between void or passageway 246 and upper inclined surface region 220, between void or passageway 248 and upper inclined surface region 222, between void or passageway 250 and lower inclined surface region 254, and between void or passageway 252 and lower inclined surface region 256. It is further seen that a vertically oriented structural rib member 266 is effectively defined between the vertically oriented wall members of the voids or passageways 246,250 and the vertically oriented wall members of the voids or passageways 248,252, and in a similar manner, a horizontally oriented structural rib member 268 is effectively defined between the horizontally oriented wall members of the voids or passageways 246,248 and the horizontally oriented wall members of the voids or passageways 250, 252.

In this manner, not only does the strategic disposition of the voids or passageways 246,248,250,252 within the thermal breaker or thermal barrier member 212 serve to define or create the aforenoted structural rib members 258,260,262, 264,266,268 for rigidifying or reinforcing the thermal breaker or thermal barrier member 212, but in addition, the provision of the voids or passageways 246,248,250,252 reduces the amount of plastic material required to fabricate the thermal breaker or thermal barrier member 212 such that significantly less plastic material is required to fabricate each thermal breaker or thermal barrier member 212 thereby rendering the manufacturing process more economical or cost-effective. Yet further, the provision of the voids or passageways 246,248, 250,252 within the domed region 216 of the thermal breaker or thermal barrier member 212 provides additional, enhanced thermal insulation properties. It is also noted that a similar void or passageway 270, having a substantially circular or oval-shaped cross-sectional configuration and providing similar manufacturing and structural attributes, is provided within the lower base portion 214 of the thermal breaker or thermal barrier member 212.

With reference now being additionally made to FIG. 4, the detailed structure of the clip 226 will now be described. More particularly, it is seen that the clip 226 is fabricated from a suitable sheet metal blank and is subsequently folded in a predetermined manner so as to have the aforenoted substantially inverted T-shaped cross-sectional configuration comprising a vertically upstanding body portion 272 and the aforenoted horizontally oriented head portion 230. The vertically upstanding body portion 272 is seen to comprise a single ply member fabricated from the sheet metal blank, however, the horizontally oriented head portion 230 is seen to comprise a two-ply member wherein a first upper side portion 274 of the sheet metal, leading from the vertically upstanding body portion 272, is effectively folded over beneath itself so as to form an undersurface portion 276, and subsequently, the undersurface portion 276 is effectively folded over atop itself so as to form an opposite second upper side portion 278. First and second upper side portions 274,278 and undersurface portion 276 therefore, collectively, define the head portion 230 of the clip 226. It is further seen that the vertically upstanding body portion 272 is provided with a plurality of through-apertures 280, and that the second upper side portion 278 has a plurality of upper tab members 282 extending integrally therefrom. The tab members 282 are adapted to respectively extend through the through-apertures 280 formed within the vertically upstanding body portion 272 and subsequently be folded downwardly, and still further, the second upper side portion 278 is also provided with a pair of additional end tab members 284 which are adapted to be folded or wrapped around the opposite end edge portions of the vertically upstanding body portion 272. In this manner, the various folded portions comprising the clip 226 are fixedly and integrally connected together in a locked arrangement such that under wind uplift conditions, such various folded portions of the clip 226 will not become separated from each other so as not to compromise the structural integrity of the clip 226. It is of course to be noted that in lieu of, for example, the holes 280 and the various folded over tab members 282,284, other means, such as, for example, welding, adhesives, or the like, may be utilized to secure the various portions of the clip 226 together. Still further, the clip 226 could be made from multiple components which would then be fixedly secured together.

With reference again being directed back toward FIG. 3, it is to be appreciated that the horizontal or transverse portion 232 of slot 228 defined within the thermal breaker or thermal barrier member 212 has a predetermined thickness dimension which is not only sufficient to accommodate the dual-ply thickness dimension characteristic of the head portion 230 of the clip 226, but in addition, the horizontal or transverse portion 232 of slot 228 has a predetermined thickness dimension which permits the head portion 230 of the clip 226 to be freely movable in the axial direction within the horizontal or transverse portion 232 of the slot 228 so as to accommodate thermal expansions and contractions of the roofing panels. In addition, it is likewise to be appreciated that in view of the fact that the vertically upstanding body portion 272 is characterized by means of a single ply sheet metal thickness, whereas the cross-sectional thickness dimension of the clip 226 at the locations corresponding to the tab members 282,284 comprises a three-ply structure, the vertically oriented portions 286,288 of the slot 228 formed within the thermal breaker or thermal barrier member 212 have different thickness dimensions which correspond to the aforenoted thickness dimensions defined by the single ply and three-ply regions of the clip 226 so as to not only accommodate such regions of the clip 226 but to also permit the clip 226 to be freely movable in the axial direction with respect to the thermal breaker or thermal barrier member 212 so as to accommodate thermal expansions and contractions of the roofing panels. It is additionally noted that the relatively narrow portion 286 of the slot 228 also serves to minimize or retard the transmission of thermal gradients between the interior of the building and the external environment.

With reference now being made to FIG. 5, a second embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 310. More particularly, the new and improved thermal breaker or thermal barrier assembly 310 is seen to comprise a thermal breaker or thermal barrier member 312, a clip 314, and a tab member 316 mounted upon the clip 314. It is seen that the clip 314 and tab member 316 are substantially similar to the conventional PRIOR ART clip 12 and tab member 22, as disclosed within FIG. 1, wherein, for example, the tab member 316 is mounted upon the clip 314 so as to be movable with respect thereto in order to permit expansion and contraction conditions for the roofing panels. The clip 314 has a substantially L-shaped cross-sectional configuration comprising a vertically oriented leg member 318 and a horizontally oriented leg member 320, and it is further seen that the thermal breaker or thermal barrier member 312 is substantially similar to the thermal breaker or thermal barrier member 212, as disclosed within FIG. 3, except for the fact that the thermal breaker or thermal barrier member 312 has a substantially hollow shell structure whereby a substantial reduction in the overall amount of plastic material, required for fabricating the thermal breaker or thermal barrier member 312, can of course be significantly reduced.

More particularly, it is further seen that the thermal breaker or thermal barrier member 312 comprises a horizontally disposed lower base portion 322 and an upper domed portion 324. The lower base portion 322 is adapted to be seated upon a joist member, not illustrated but similar to the joist member 118 illustrated within FIG. 2, of an underlying roofing substructure, and is adapted to be secured to such joist member by means of, for example, a pair of headed bolt fasteners 326, 326. The lower base portion 322 is seen to be fabricated so as to comprise upper and lower sections 328 and 330 whereby a transversely oriented slot 332 is formed therebetween so as to accommodate the horizontally oriented leg member 320 of the clip 314, and it is to be appreciated that the pair of headed bolt fasteners 326,326 will pass through the sandwich structure comprising the upper base section 328 of the lower base portion 322, the horizontally oriented leg member 320 of the clip 314, and the lower base section 330 of the lower base portion 322.

The upper domed portion 324 is seen to have a substantially diamond-shaped cross-sectional configuration comprising oppositely disposed upper divergent inclined wall members 334,336, an upper substantially planar wall member 338 which is disposed substantially parallel to the horizontally oriented lower base portion 322, and a pair of oppositely disposed lower convergent inclined wall members 340,342 which effectively interconnect the oppositely disposed upper divergent inclined wall members 334,336 to the lower base portion 322. Vertically oriented bores 344,344 are formed within the lower base portion 322 and the upper domed portion 324 in a manner similar to that characteristic of the bores 236,236 formed within the thermal breaker or thermal barrier member 212 as disclosed within FIG. 3, however, it is additionally noted, for example, that suitable plastic bushings, not shown, are disposed around the threaded shank portions of the fasteners 326,326 so as to prevent the same from being disposed in contact with the horizontally oriented leg member 320 of the clip 314. The upper wall member 338 of the thermal breaker or thermal barrier member 312 is also provided with a slot 346 so as to permit the vertically oriented leg member 318 of the clip 314 and the tab member 316 to be disposed therein and to pass therethrough. It is lastly noted that, while not actually illustrated, the external surface portions of the upper divergent inclined wall members 334,336, the upper wall member 338, and the lower base section 330 of the lower base portion 322 are preferably provided with axially extending rib members similar to the rib members 240, 242,244 as disclosed in connection with the thermal breaker or thermal barrier member 212 of FIG. 3.

With reference now being made to FIG. 6, a third embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 410. More particularly, the new and improved thermal breaker or thermal barrier assembly 410 is seen to comprise a thermal breaker or thermal barrier member 412, and a clip 414. It is to be appreciated that the thermal breaker or thermal barrier member 412 is substantially similar to the conventional PRIOR ART thermal breaker or thermal barrier member 112 as disclosed within FIG. 2, and similarly for the clip 414 with respect to the clip 226 as disclosed within FIGS. 3 and 4, except for the fact that the upper domed portion of the thermal barrier or thermal breaker member 412 is fabricated as a two-part construction comprising first and second mating sections 416-1,416-2 with the first section 416-1 being integrally connected to the lower base portion 418 which is adapted to be seated upon, and secured to, a joist member of the underlying roofing substructure. The two-part construction may be fabricated by injection molding, pulltrusion, extrusion, or machining techniques, and accordingly, each one of the thermal breaker or thermal barrier domed sections 416-1,416-2 is respectively provided with a mating slot 420-1,420-2 for accommodating the head portion 422 of the clip 414.

A pair of vertically oriented bores 424,424 are likewise respectively molded within the first and second mating domed sections 416-1,416-2 in a counterbored manner for permitting a pair of headed bolt fasteners 426,426 to pass therethrough, as well as through cut-out sections 425,425 formed within the head portion 422 of the clip 414, similar to those cut-out sections discussed but not shown in connection with the clip 226 of FIG. 3, such that the head portions of the fasteners 426,426 will be disposed and seated beneath the head portion 422 of the clip 414 and yet be disposed within the second domed section 416-2 so as to not only secure the second domed section to the first domed section 416-1, but in addition, to fixedly secure the thermal breaker or thermal barrier assembly 410 onto the joist member of the underlying roofing substructure. The disposition of the head portions of the fasteners 426,426 beneath the head portion 422 of the clip 414 also prevents any interference with any axial movement that the clip 414 may undergo in accordance with roofing panel expansion and contraction conditions. It is also noted that the fabrication of the thermal breaker or thermal barrier member 412 as a two-part injection molding not only reduces the injection molding cycle time for each separate component 416-1,416-2, but in addition, facilitates the formation of slots 420-1,420-2, as well as the bores 424, 424. As was the case with the thermal breaker or thermal barrier assembly 310 as disclosed within FIG. 5, it is lastly noted that, while not actually illustrated, the external surface portions of the upper divergent inclined wall members 428,430, the upper wall member 432, and the lower base portion 418 are preferably provided with axially extending rib members similar to the rib members 240,242,244 as disclosed in connection with the thermal barrier or thermal breaker member 212 of FIG. 3.

Turning now to FIG. 7, a fourth embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 510. More particularly, the new and improved thermal breaker or thermal barrier assembly 510 is seen to comprise a clip 512 and a tab member 514, movably mounted upon the clip 512, which are characterized by structures which are substantially similar to those structures that are characteristic of the conventional PRIOR ART clip 12 and tab member 22 as disclosed within FIG. 1. The clip 512 is seen to have a substantially L-shaped cross-sectional configuration comprising a vertically oriented leg member 516 and a horizontally oriented leg member 518, and the tab member 514 is mounted upon the clip 512 by means of a dimpled detent member 520 engageable within a suitable concavity, not shown, such that the tab member 514 is easily displaceable from its normally central disposition upon the clip 512. The upper region of the vertically oriented leg member 516 of the clip 512 is provided with an axially extending slot 522, and the tab member 514 is provided with an outwardly projecting, elongated lug portion 524 for guided disposition with the axially extending slot 522. In addition, the upper end portion of the vertically oriented leg member 516 of the clip 512 is provided with oppositely projecting lugs or ears 526, 528, and the tab member 514 is provided with a free end portion 530 which is adapted to be crimped together with the side edge portions of the roofing panels to be secured together. In this manner, the tab member 514, to which the roofing panels are connected, is capable of being moved with respect to the clip 512 so as to accommodate or permit expansion and contraction conditions for the roofing panels.

In accordance with further structural features developed in accordance with the principles and teachings of the present invention, it is additionally seen that, in order to provide the thermal breaker or thermal barrier assembly 510 with thermal isolation properties a plastic sheet 532 is folded over upon itself so as to effectively form a sleeve member which not only covers the free edge portion of the horizontally oriented leg member 518 of the clip 512 but additionally comprises upper and lower sections or plies 534, 536 which are adapted to be respectively seated upon the upper and lower surface portions of the horizontally oriented leg member 518 of the clip 512. A pair of threaded headed bolt fasteners 538,538 are adapted to be inserted through particular ones of a plurality of apertures 540 formed within the upper and lower plies 534,536 of the sleeve member 532, as well as within the horizontally oriented leg member 518 of the clip 512, so as to fixedly secure the thermal breaker or thermal barrier assembly 510 upon the joist of the underlying roofing substructure, and it is noted that plastic bushings, not shown, may be disposed around the shank portions of the fasteners 538,538 so as to effectively prevent any metal-to-metal contact between the fasteners 538,538 and the horizontally oriented leg member 518 of the clip 512. As was the case with the thermal breaker or thermal barrier assemblies 310,410 as disclosed within FIGS. 5 and 6, it is lastly noted that, while not actually illustrated, the external undersurface portion of the lower ply 536 of the sleeve member 532 may be provided with axially extending rib members similar to the rib members 240,242,244 as disclosed in connection with the thermal barrier or thermal breaker member 212 of FIG. 3.

Turning now to FIG. 8, a fifth embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 610. It is initially noted that the thermal breaker or thermal barrier assembly 610 as disclosed within FIG. 8 is substantially the same as the thermal breaker or thermal barrier assembly 510 as disclosed in FIG. 7, except as will be noted immediately hereinafter, and accordingly, a detailed description of the thermal breaker or thermal barrier assembly 610 will be omitted in the interest of brevity, the description of the same being focused upon the aforenoted differences between the thermal breaker or thermal barrier assembly 610 as disclosed within FIG. 8 and the thermal breaker or thermal barrier assembly 510 as disclosed within FIG. 7. It is also noted that components parts of the thermal breaker or thermal barrier assembly 610, which correspond to the component parts of the thermal breaker or thermal barrier assembly 510, will be designated by corresponding reference characters except that they will be within the 600 series.

More particularly then, it is initially seen that the clip 612 has a uniquely sculpted configuration wherein the clip 612 still has the substantially L-shaped cross-sectional configuration comprising the vertically oriented leg member 616 and the horizontally oriented leg member 618, the vertically oriented and horizontally oriented leg members 616,618 being connected together by means of oppositely disposed transitional regions 619,619, however, it is additionally seen that the axial extent of the horizontally oriented leg member 618 has effectively been substantially reduced with respect to the axial extent of the vertically oriented leg member 616. In this manner, the horizontally oriented leg member 618 can nevertheless be fixedly connected to the joist member of the underlying roofing substructure by means of the head bolt fasteners 638, while reducing the amount of material required to fabricate the horizontally oriented leg member 618, however the axial extent of the vertically oriented leg member 616 is effectively preserved such that the axial movements of the tab member 614, connected to the mated side edge portions of the roofing panels, can be preserved to the maximum extent so as to ensure, and not confine, the expansion and contraction movements of the roofing panels. Still further, another unique feature characteristic of this particular embodiment of the thermal breaker or thermal barrier assembly 610 is disclosed in connection with the plastic sheet 632 which is folded over upon itself so as to effectively form a sleeve member which not only covers the free edge portion of the horizontally oriented leg member 618 of the clip 612, but also comprises the upper and lower sections or plies 634,636 which are adapted to be respectively seated upon and cover the upper and lower surface portions of the horizontally oriented leg member 618, as was the case with the sleeve member 532 of the thermal breaker or thermal barrier assembly 510 as disclosed within FIG. 7.

More particularly, as can best be seen from FIG. 8*a*, the upper section or ply 634 of the sleeve member 632 is provided with a pair of through-apertures 640,640 for accommodating the shank portions of the headed threaded bolt fasteners 638, while the lower section or ply 636 is integrally provided with a pair of upstanding bushings 642,642. Therefore, when the sleeve member 632 is in fact fully folded upon itself so as to encase the horizontally oriented leg member 618 of the clip 612, the bushings 642,642 will project upwardly and pass through the apertures formed within the horizontally oriented leg member 618 of the clip 612 and also project through the apertures 640,640 formed within the upper section or ply 634 of the sleeve member 632. In this manner, there is no metal-to-metal contact established between the threaded bolt fasteners 638,638 and the horizontally oriented leg member 618 of the clip 612. It is also again noted that, as was the case with the thermal breaker or thermal barrier assemblies 310, 410, 510 as disclosed within FIGS. 5-7, the external undersurface portion of the lower ply 636 of the sleeve member 632 may be provided with axially extending rib members similar to the rib members 240,242,244 as disclosed in connection with the thermal barrier or thermal breaker member 212 of FIG. 3.

With reference now being made to FIG. 9, a sixth embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 710. It is initially noted that the thermal breaker or thermal barrier assembly 710 as disclosed within FIG. 9 has substantially similar overall geometrical shapes or contours as those of the thermal breaker or thermal barrier assembly 610 as disclosed within FIG. 8 except that in lieu of the clip 712 being fabricated from steel or a similar metal, as is the case of the clip 612 of the thermal breaker or thermal barrier assembly 610, the clip 712 is fabricated from a plastic material similar to that used to fabricate the thermal breaker or thermal barrier members 212,312,and 412 of the thermal breaker or thermal barrier assemblies 210,310, and 410. In addition, in lieu of clip 712 having a substantially L-shaped cross-sectional configuration as is characteristic of the clip 612, clip 712 has a substantially T-shaped cross-sectional configuration comprising a vertically oriented plate member 714 and a horizontally oriented platform 716 to which the lower end portion of the vertically oriented plate member 714 is integrally attached. The clip 712 may be fabricated by means of any well-known techniques, such as, for example, injection molding, extrusion, pulltrusion, or the like, and it is further seen that a pair of gussets or angle brackets 718, 718 integrally interconnect each side of the lower end portion of the vertically oriented plate member 714 to the horizontally oriented platform 716. A pair of headed threaded bolt fasteners 720 are inserted through the horizontally oriented platform 716 so as to fixedly connect the clip 712 to the joist member of the underlying roofing substructure.

Continuing further, it is also seen that the clip 712 has a uniquely sculpted configuration similar to that of the clip 612, as disclosed within FIG. 8, wherein the upper end portion of the vertically oriented plate member 714 of the clip 712 is integrally connected to the lower end portion of the vertically oriented plate member 714 by means of oppositely disposed transitional regions 722,722 whereby, as was the case with the clip 612 of the embodiment disclosed within FIG. 8, the axial extent of the horizontally oriented platform 716 is effectively reduced with respect to the axial extent of the vertically oriented plate member 714. In this manner, the horizontally oriented platform 716 can nevertheless be fixedly connected to the joist member of the underlying roofing substructure by means of the headed bolt fasteners 720,720 while reducing the amount of material required to fabricate the horizontally oriented platform member 716, however the axial extent of the vertically oriented plate member 712 is effectively preserved such that the axial movements of the tab member 724, connected to the mated side edge portions of the roofing panels, can be preserved so as to effectively permit maximum expansion and contraction movements of the roofing panels. It is lastly seen that the vertically oriented plate member 714 is provided with an axially oriented slot 726, and that the tab member 724 is provided with a lug member 728 which maintains the tab member 724 movably mounted upon the vertically oriented plate member 714 of the clip 712. It is also again noted that, as was the case with the thermal breaker or thermal barrier assemblies 310,410,510 as disclosed within FIGS. 5-7, the external undersurface portion of the platform 716, as well as the upper surface portion 730 of the vertically oriented plate member 714 may be provided with axially extending rib members similar to the rib members 240,242, 244 as disclosed in connection with the thermal barrier or thermal breaker member 212 of FIG. 3.

Turning now to FIG. 10, a seventh embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 810. It is initially noted that the thermal breaker or thermal barrier assembly 810 as disclosed within FIG. 10 is substantially the same as the thermal breaker or thermal barrier assembly 710 as disclosed within FIG. 9, except as will be noted hereinafter, and therefore, in the interest of brevity, a detailed description of the thermal breaker or thermal barrier assembly 810 will be omitted herefrom. It is additionally noted that component parts of the thermal breaker or thermal barrier assembly 810 as disclosed within FIG. 10, which correspond to component parts of thermal breaker or thermal barrier assembly 710 as disclosed within FIG. 9, will be designated by corresponding reference characters except that they will be within the 800 series. More particularly, it is noted that the only significant difference between the thermal breaker or thermal barrier assembly 810, as disclosed within FIG. 10, and the thermal breaker or thermal barrier assembly 710, as disclosed within FIG. 9, resides in the fact that each one of the oppositely disposed end portions of the upper surface portion 830 of the vertically oriented plate member 814 is provided with a pair of shoulder members 832,832 projecting outwardly from the plane of the vertically oriented plate member 814 so as to effectively provide or serve as sculpted or contoured seating means for supporting the side edge portions of the roofing panels to be mated together. It is also again noted that the external undersurface portion of the platform 816, as well as the upper surface portion 830 of the vertically oriented plate member 814 may be provided with axially extending rib members similar to the rib members 240,242,244 as disclosed in connection with the thermal barrier or thermal breaker member 212 of FIG. 3.

With reference now being lastly made to FIG. 11 in connection with the various embodiments of the thermal breaker or thermal barrier assemblies of the present invention, an eighth embodiment of a new and improved thermal breaker or thermal barrier assembly, constructed in accordance with the principles and teachings of the present invention and showing the cooperative parts thereof, for fixedly connecting mating edge portions of adjacent roofing panels to underlying joist members of a roof decking substructure is disclosed and is generally indicated by the reference character 910. It is initially noted that the thermal breaker or thermal barrier assembly 910 as disclosed within FIG. 11 is effectively a hybrid or composite of the structural features and teachings of the thermal breaker or thermal barrier assemblies 610 and 710 as disclosed within FIGS. 8 and 9, and therefore, in the interest of brevity, a detailed description of the thermal breaker or thermal barrier assembly 910 will be omitted herefrom. It is additionally noted that component parts of the thermal breaker or thermal barrier assembly 910 as disclosed within FIG. 11, which correspond to component parts of the thermal breaker or thermal barrier assemblies 610 and 710 as disclosed within FIGS. 8 and 9, will be designated by corresponding reference characters except that they will be within the 900 series. More particularly, it is noted that the thermal breaker or thermal barrier assembly 910 comprises a metal clip 912, within which there is movably mounted a tab member 914, and that the metal clip 912 is substantially similar to the clip 612, as disclosed within the thermal breaker or thermal barrier assembly 610 of FIG. 8, except for the fact that the metal clip 912 does not have a substantially L-shaped cross-sectional configuration but, to the contrary, comprises a vertically oriented planar member comprising a vertically upper section 916 and a vertically lower section 918, the vertically upper and vertically lower sections being connected together by means of oppositely disposed transitional regions 919, 919.

In addition, in accordance with the unique structural characteristics of the thermal breaker or thermal barrier assembly 910, it is seen that the vertically lower section 918 of the clip 912 is adapted to be fixedly mounted within a thermal breaker or thermal barrier member 932. The thermal breaker or thermal barrier member 932 is seen to comprise a horizontally oriented base section or platform 934 and a pair of vertically upstanding plate members 936,936 which effectively form a clevis structure so as to accommodate the vertically lower section 918 of the clip 912 therebetween. The base section or platform 934 of the thermal barrier or thermal breaker member 932 is adapted to be fixedly secured to the joist member of the underlying roofing substructure by means of a first pair of headed, threaded bolt fasteners 938,938, and the vertically lower section 918 of the clip 912 is adapted to be fixedly secured between the vertically upstanding plate members 936, 936 of the thermal breaker or thermal barrier member 932 by means of a second pair of headed, threaded bolt fasteners 940,940. It is lastly noted that the external undersurface portion of the base section or platform 934 may be provided with axially extending rib members similar to the rib members 244 as disclosed in connection with the thermal barrier or thermal breaker member 212 of FIG. 3.

With reference now being lastly made to FIGS. 12-19, several embodiments of different structures that may effectively be incorporated internally within, or upon the external surface regions of, the various thermal breaker or thermal barrier members or assembly components in order to render the same more thermally efficient, or, in other words, to effectively prevent the occurrence of thermal heat loss, will now be disclosed. For example, in lieu of the axially oriented rib structures 240,242,244 illustrated within FIG. 3 in connection with the various external surface regions of the thermal breaker or thermal barrier member 212, the rib structures 240,242,244 may effectively be replaced by means of a plurality of wavy or sinusoidal structures or surface projections 1012, as disclosed within FIG. 12, which are integrally incorporated upon the particular external surface component 1010. In a similar manner, as disclosed within FIG. 13, a thermal breaker or thermal barrier assembly 1110 comprises a thermal breaker or thermal barrier member 1112 having a cross-sectional configuration similar to, for example, that of the thermal breaker or thermal barrier member 212, as disclosed within FIG. 3, wherein the thermal breaker or thermal barrier member 1112 comprises a lower base section 1114 and an upper domed section 1116. The upper domed section 116 comprises oppositely disposed inclined surface portions 1120 and 1122, and in accordance with this particular embodiment of the present invention, the inclined surface portions 1120, 1122, as well as the upper surface portion 1124 of the domed section 1116 and the undersurface portion of the lower base section 1114, may be provided with a plurality of axially oriented projections 1140,1142,1144 wherein each one of the axially oriented projections 1140,1142,1144 has a substantially triangular cross-sectional configuration. Alternatively still further, in lieu of the axially oriented projections 1140, 1142,1144 having the aforenoted cross-sectional configurations, the projections 1140,1142,1144 could comprise conically configured bumps or projections having the substantially triangular cross-sectional configurations as illustrated.

Continuing still further, and with reference being made to FIG. 14, it is seen that in accordance with a fourth embodiment of a heat-loss reducing structure, that may be incorporated upon the external surface portions of a thermal breaker or thermal barrier member 1212 of a thermal breaker or thermal barrier assembly 1210 constructed in accordance with the principles and teachings of the present invention, the thermal breaker or thermal barrier member 1212 is illustrated as having an irregular coarse surface structure 1214 which simulates, for example, the external surface of an orange rind. In a similar manner, as illustrated within FIG. 15, a thermal breaker or thermal barrier member 1312 of a thermal breaker or thermal barrier assembly 1310, constructed in accordance with the principles and teachings of the present invention, may have other irregular coarse surface features or structure 1314 which may comprise or simulate, for example, a matte finish, a knurled type finish, or the like.

Figure 16:
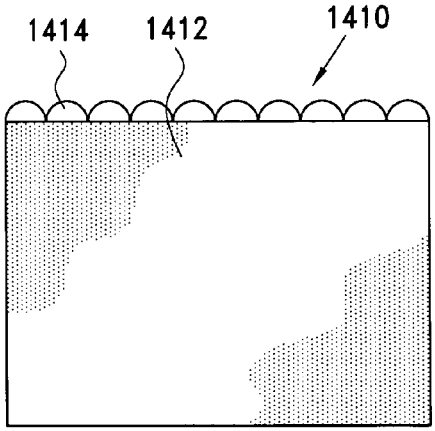
FIG. 16 is a schematic side elevational view of a sixth embodiment of bump structure which may effectively be incorporated onto any of the external surface regions of the thermal barrier or thermal breaker member, in lieu of the axially oriented rib members as disclosed within FIG. 3, so as to minimize the surface contact area and thereby render the thermal breaker or thermal barrier assembly more thermally efficient.

As can be appreciated still further from FIG. 16, a sixth embodiment of a heat-loss reducing structure, that may be integrally incorporated upon the external surface portions of a thermal breaker or thermal barrier member 1412 of a thermal breaker or thermal barrier assembly 1410, as constructed in accordance with the principles and teachings of the present invention, may comprise a plurality of bumps or projections 1414 wherein each one of the plurality of bumps or projections 1414 has a substantially hemispherical cross-sectional configuration and the bumps or projections 1414 are contiguous to, or abut, each other. They may be arranged within a plurality of rows so as to simultaneously form a plurality of columns, and, still further, for example, the rows may also be contiguous to, or abut, each other, such that all of the bumps or projections 1414, as considered in either one of the mutually orthogonal directions comprising the array of rows and columns, are contiguous to, or abut, each other.

Figure 17:
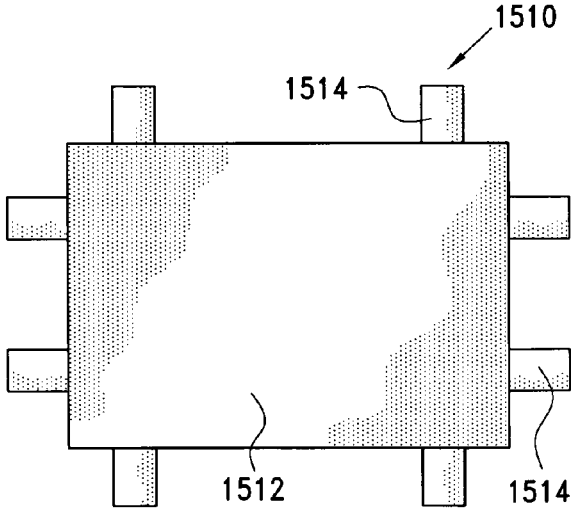
FIG. 17 is a schematic side elevational view of a seventh embodiment of stand-off structure which may effectively be incorporated onto any of the external surface regions of the thermal barrier or thermal breaker member, in lieu of the axially oriented rib members as disclosed within FIG. 3, so as to minimize the surface contact area and thereby render the thermal breaker or thermal barrier assembly more thermally efficient.
Figure 18:
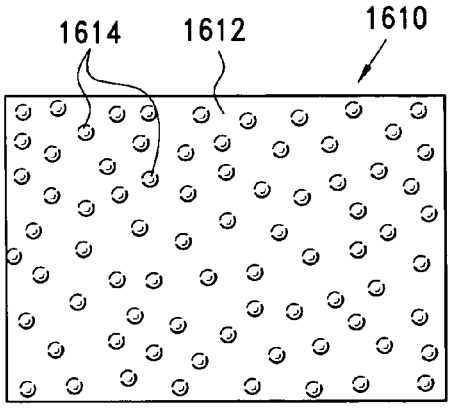
FIG. 18 is a schematic side elevational view of an eighth embodiment of dimpled structure which may effectively be incorporated onto any of the external surface regions of the thermal barrier or thermal breaker member, in lieu of the axially oriented rib members as disclosed within FIG. 3, so as to minimize the surface contact area and thereby render the thermal breaker or thermal barrier assembly more thermally efficient.

With reference now being made to FIG. 17, a seventh embodiment of heat-loss reducing structure, that may be integrally incorporated upon the external surface portions of a thermal breaker or thermal barrier member 1512 of a thermal breaker or thermal barrier assembly 1510, as constructed in accordance with the principles and teachings of the present invention, may comprise a plurality of laterally spaced boss or stud-type standoffs 1514 wherein each one of the plurality of standoffs 1514 has a substantially cylindrical cross-sectional configuration. The number of standoffs 1514 disposed upon any one of the particular external surface portions of the thermal breaker or thermal barrier member 1512 may vary and they may be arranged within, for example, a suitable grid pattern comprising a plurality of rows and columns. FIG. 18 discloses a still additional eighth embodiment of heat-loss reducing structure, that may be integrally incorporated upon the external surface portions of a thermal breaker or thermal barrier member 1612 of a thermal breaker or thermal barrier assembly 1610, as constructed in accordance with the principles and teachings of the present invention, wherein the same comprises a plurality dimple members 1614 disposed either within a uniformly arranged, or a non-uniform, randomly arranged array upon the external surface portions of the thermal breaker or thermal barrier member 1612 of the thermal barrier or thermal breaker assembly 1610. While the dimples 1614 are disclosed as comprising convex structures, the same may alternatively comprise concave structures wherein the plurality of dimples 1614 nevertheless provide the overall external surface portion of the thermal breaker or thermal barrier member 1612 with an irregular surface structure such that surface-to-surface contact is not in fact established between the thermal breaker or thermal barrier member 1612 and the roofing panels or joist member of the underlying roofing substructure.

Figure 19:
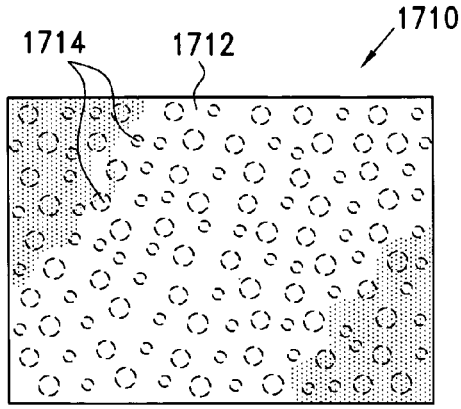
FIG. 19 is a schematic side elevational view of a ninth embodiment of air bubble structure which may effectively be incorporated internally within the thermal barrier or thermal breaker, in lieu of, or in addition to, the axially oriented rib members as disclosed within FIG. 3, so as to minimize thermal gradient transmissions and thereby render the thermal breaker or thermal barrier assembly more thermally efficient.

With reference lastly being made to FIG. 19, a ninth embodiment of heat-loss reducing structure, that may be internally incorporated within the thermal breaker or thermal barrier member 1712 of a thermal breaker or thermal barrier assembly 1710, as constructed in accordance with the principles and teachings of the present invention, is disclosed, and it is seen that the same comprises a plurality of air bubbles 1714 disposed either within a uniformly arranged, or a non-uniform, randomly arranged array internally within the thermal breaker or thermal barrier member 1712 of the thermal barrier or thermal breaker assembly 1710. It is to be noted that the air bubble structures 1714 may be utilized alone or in conjunction with any of the other thermal loss-reducing structures disclosed within FIGS. 3 and 12-18, and when being used alone, even though the external surface portions of the thermal breaker or thermal barrier assemblies would be disposed in surface-to-surface contact with the roofing panels and joist member of the underlying roofing substructure, the thermal flow path would effectively be interrupted by means of the air bubbles 1714 so as to adequately reduce the thermal transmissions.

Thus, it may be seen that in accordance with the teachings and principles of the present invention, there has been disclosed thermal breaker or thermal barrier structures, for use in connection with roof decking assemblies, for effectively preventing the respective transmission of heating gradients from the interior or exterior building environments to the exterior or interior building environments by thermal conductivity so as to render the building more energy efficient.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by letters patent of the united states of america, is:

1. A thermal breaker assembly, for connecting roofing panels to joist members of a roofing substructure so as to effectively prevent the transmission of thermal gradients between the roofing panels and the joist members, comprising:

a clip member;

an axially oriented slot defined within said clip member;

tab structure connected to said clip member and adapted to be connected to side edge portions of adjacent roofing panels so as to connect the side edge portions of the adjacent roofing panels together, said tab structure having a lug member projecting through said slot defined within said clip member so as to permit said tab structure to be movably mounted upon said clip member;

a thermal breaker, having a predetermined axial extent, fabricated from thermal insulation material, having a base portion for seating upon and connection to at least one of the joist members of the roofing substructure, and adapted to be connected to said clip member so as to effectively prevent the transmission of thermal gradients between the roofing panels and the at least one of the joist members of the roofing substructure; and first structure integrally incorporated upon an undersurface portion of said thermal breaker for rendering said undersurface portion of said thermal breaker non-planar so as to minimize the surface-to-surface contact defined between said thermal breaker and the at least one of the joist members of the roofing substructure and thereby minimize the transmission of thermal gradients between the at least one of the joist members of the roofing substructure and the roofing panels.

2. The thermal breaker assembly as set forth in claim 1, wherein:

both said clip member and said tab means are fabricated from a metal material.

3. The thermal breaker assembly as set forth in claim 1 wherein:

said clip member has a substantially planar configuration; and said thermal breaker comprises a base member, and a pair of plate members extending upwardly from said base member and spaced from each other so as to define a slot therebetween within which said lower region of said clip member is fixedly disposed.

4. The thermal breaker assembly as set forth in claim 1, wherein:

said first structure integrally incorporated upon said undersurface portion of said thermal breaker, for rendering said undersurface portion of said thermal breaker non-planar so as to minimize the surface-to-surface contact defined between said thermal breaker and the at least one of the joist members of the roofing substructure and thereby minimize the transmission of thermal gradients between the at least one of the joist members of the roofing substructure and the roofing panels, comprises axially oriented rib members.

5. The thermal breaker assembly as set forth in claim 3, wherein:

said substantially planar clip member has a first upper region having a first predetermined axially oriented extent, a second lower region having a second predetermined axially oriented extent less than said first predetermined axial oriented extent of said first upper region, and a pair of transitional regions interconnecting together said first upper region and said second lower region.

6. The thermal breaker assembly as set forth in claim 5, further comprising:

first fastener means for fixedly securing said thermal breaker to said at least one of the joist members of the roofing substructure; and second fastener means, passing through said pair of plate members extending upwardly from said base member and spaced from each other for fixedly securing said lower end portion of said clip therebetween.

* * * * *